US008464870B2

(12) United States Patent
Weissbrod

(10) Patent No.: US 8,464,870 B2
(45) Date of Patent: Jun. 18, 2013

(54) SPOOL PACKAGING MEMBER AND METHOD

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 251 days.

(21) Appl. No.: 13/091,771

(22) Filed: Apr. 21, 2011

(65) Prior Publication Data

US 2012/0267274 A1 Oct. 25, 2012

(51) Int. Cl.
*B65D 85/66* (2006.01)

(52) U.S. Cl.
USPC ..... 206/389; 206/303; 206/408; 53/456; 53/467

(58) Field of Classification Search
USPC ..... 206/303, 389, 391, 392, 394, 395, 206/403, 408, 411, 413, 414, 557, 564; 53/452, 53/456, 467, 468, 473, 146; 229/147, 149, 229/154; 242/588.3, 588.4, 588.6
See application file for complete search history.

(56) References Cited

U.S. PATENT DOCUMENTS

| | | | | |
|---|---|---|---|---|
| 1,691,995 | A | 1/1926 | Saulter | |
| 2,846,061 | A | 8/1958 | Wilke | |
| 2,873,025 | A * | 2/1959 | Rollie | 206/394 |
| 2,935,190 | A * | 5/1960 | Braun | 206/408 |
| 2,973,858 | A | 3/1961 | Laneve et al. | |
| 3,233,728 | A * | 2/1966 | Johnson et al. | 206/395 |
| 3,329,259 | A | 7/1967 | Mayer | |
| 3,412,847 | A | 11/1968 | Wise et al. | |
| 3,491,876 | A | 1/1970 | Zecchin | |
| 3,753,407 | A | 8/1973 | Tilseth | |
| 3,811,639 | A | 5/1974 | Jordan | |
| 3,910,409 | A | 10/1975 | Fortlage | |
| 4,003,529 | A | 1/1977 | Nigro | |
| 4,122,949 | A * | 10/1978 | Blatt | 206/303 |
| 4,179,030 | A | 12/1979 | Hayes et al. | |
| 4,201,300 | A | 5/1980 | Klingaman et al. | |
| 4,582,198 | A | 4/1986 | Ditton | |
| 4,667,824 | A * | 5/1987 | Ditchfield | 206/408 |
| 5,284,246 | A * | 2/1994 | Chamberlin et al. | 206/394 |
| 5,328,123 | A | 7/1994 | LeNoue et al. | |
| 5,622,260 | A * | 4/1997 | Chamberlin et al. | 206/394 |
| 5,704,479 | A | 1/1998 | Barnett et al. | |
| 5,861,204 | A | 1/1999 | O'Sullivan | |
| 6,007,018 | A | 12/1999 | Potteiger et al. | |
| 6,439,385 | B1 | 8/2002 | Remde | |
| 6,749,139 | B2 | 6/2004 | Speck | |
| 8,210,464 | B1 * | 7/2012 | Selby | 242/588.3 |

FOREIGN PATENT DOCUMENTS

| | | | |
|---|---|---|---|
| CA | 1111385 | A1 | 10/1981 |
| WO | 0123292 | A1 | 4/2001 |

* cited by examiner

*Primary Examiner* — Luan K Bui
(74) *Attorney, Agent, or Firm* — Hahn Loeser & Parks LLP

(57) ABSTRACT

A packaging member includes a base with a central portion and a pair of opposed walls extending in the same direction from opposing edges of the central portion. The packaging member also includes a locator panel with a perimeter corresponding to the perimeter of the base central portion and an aperture defined by a sidewall. The locator panel is retained upon the base between the pair of opposed walls. Additionally, the packaging member includes a plurality of spaced apart tabs with first portions which are affixed to the sidewall and have a profile corresponding to the profile of the sidewall.

20 Claims, 7 Drawing Sheets

SPOOL PACKAGING MEMBER AND METHOD

FIELD OF INVENTION

The present invention relates generally to packaging and methods for the shipping of wire, and more particularly to spools wound with welding wire electrodes.

BACKGROUND

Over the past decades, welding has become a dominant process in fabricating industrial and commercial products. Applications for welding are wide spread and used throughout the world. Examples include the construction of ships, buildings, vehicles and pipe lines. Welding is also used in repairing or modifying existing products. Among the various methods of joining metal components, arc welding is one well known and very common process.

Arc welding may employ consumable welding wire, which in some instances may be wound on a spool for ease of dispensing. For purposes of protection during storage and shipping, such spools may be placed in cardboard cartons. While such cartons have provided sufficient protection during bulk shipment of spooled electrodes to distributors, the market for direct-to-consumer shipping requires additional safeguards for spools. Accordingly, what is needed is a packaging member which cushions the face of spool in a carton in the event that a carton is dropped on one of its faces, as well as a packaging member which adds additional stability to a shipping carton at its corners in the case where a carton is dropped on an edge or corner.

SUMMARY OF THE INVENTION

In one embodiment, a packaging member comprises a base, a locator panel, and a plurality of spaced apart tabs. The base has a central portion and a pair of opposed walls extending in the same direction from opposing edges of the central portion. The locator panel has a perimeter corresponding to the perimeter of the base central portion and an aperture defined by a sidewall, and the locator panel is retained upon the base between the pair of opposed walls. The plurality of spaced apart tabs have a first portion corresponding to the profile of the sidewall and the tab first portions are affixed to the sidewall.

DETAILED DESCRIPTION OF THE INVENTION

Figure 1:
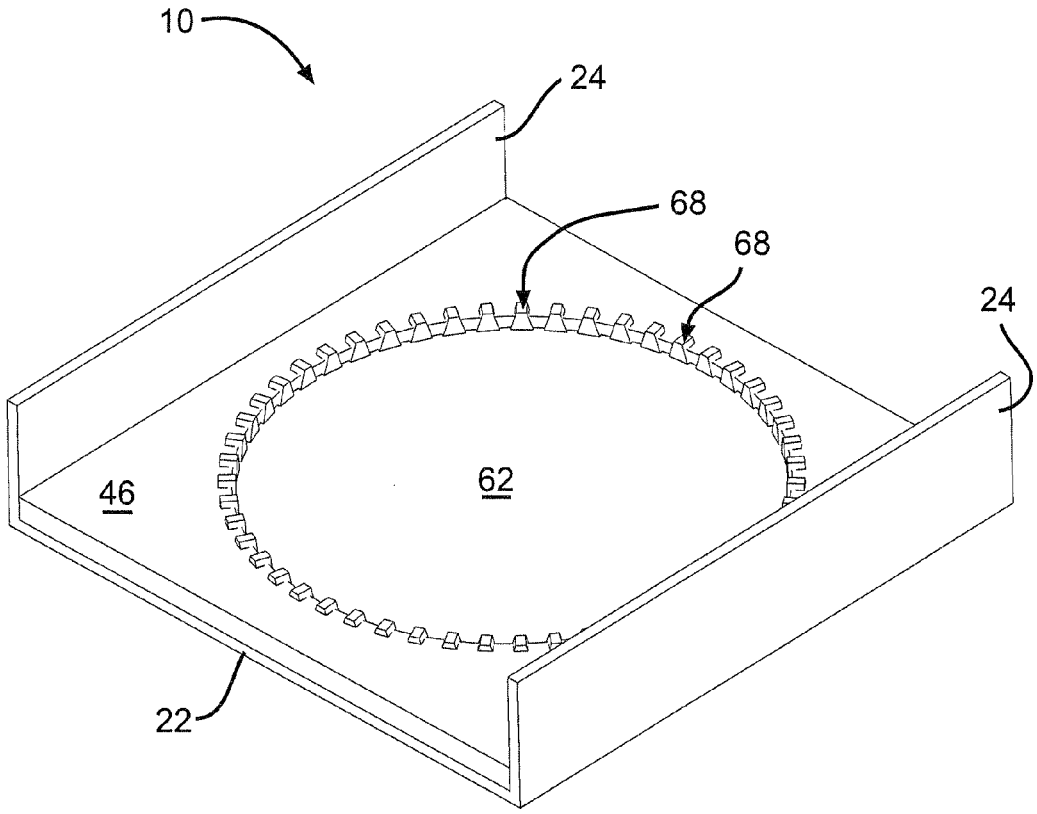
FIG. 1 is a perspective view of one embodiment of a packaging member.
Figure 2:
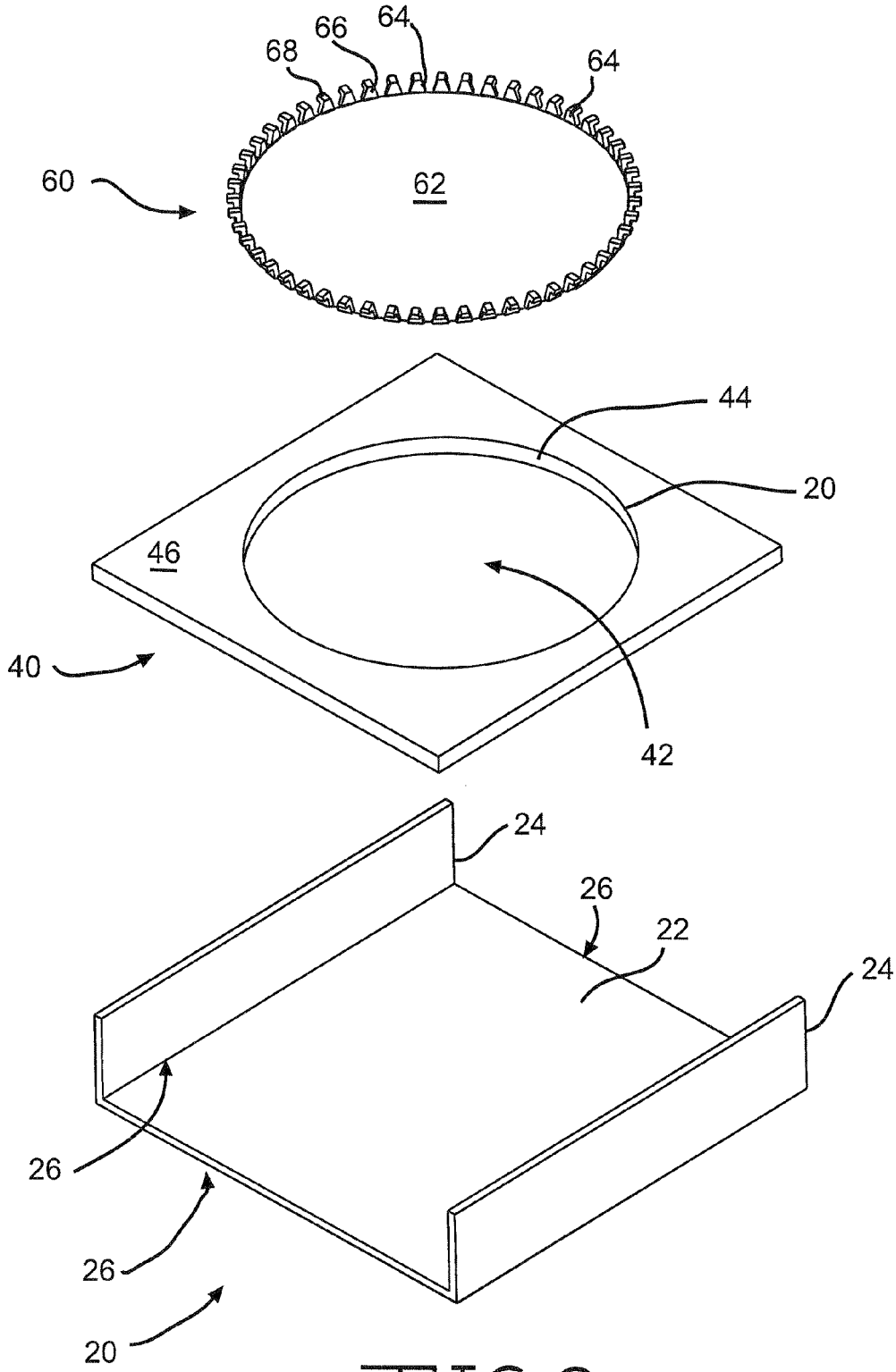
FIG. 2 is an exploded perspective view of the packaging member shown in FIG. 1.
Figure 3:
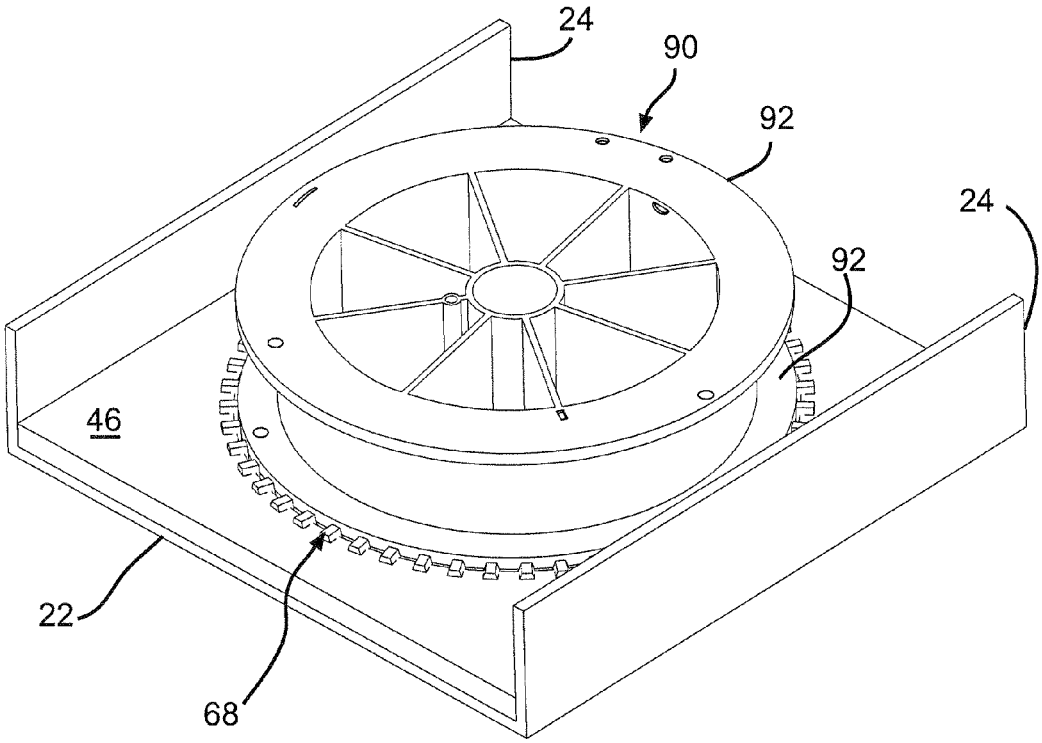
FIG. 3 is a perspective view of the packaging member shown in FIG. 1 with an inserted spool.

Referring now to the drawings wherein the showings are for purposes of illustrating embodiments of the disclosed subject matter only and not for purposes of limiting the same, FIGS. 1-3 show a packaging member 10 utilized for storage and transport of spools or other objects. In one embodiment, the packaging member 10 comprises a base 20, a locator panel 40, and a support sheet 60. As shown in FIG. 3, the packaging member 10 may be configured to receive a cylindrical article, such as a spool 90. More specifically, the packaging member 10 may be dimensioned to receive a flange 92 of a spool.

Still referring to FIGS. 1-3, the base 20 includes a central portion 22 and a pair of opposed walls 24 extending from opposing edges 26 of the base 20. For purposes of this application, this configuration may be referred to as U-shaped. The base 20 may be formed from a single sheet of flat material, where the central portion 22 is separated from the opposed walls 24 by a pair of scores or perforations. Accordingly, the central portion 22 is preferentially planar. In one embodiment, the base 20 may be formed from double-wall corrugated cardboard, although other suitable materials are also contemplated. So as to maintain as much structural integrity as possible, the scores in the base may be made perpendicular to the length of the corrugation within the cardboard sheet.

Alternately, the central portion 22 and the opposed walls 24 may be separate pieces, where the opposed walls 24 are affixed to opposing edges 26 of central portion to form the base 20. For example, the opposed walls 24 may be glued to the central portion 22.

Regardless of whether the base 20 is formed from one sheet of flat material or assembled from multiple pieces of material, the base 20 may be supplied as a stack of flat material and subsequently folded along the scores or assembled into the desired U-shape on an as-needed basis. Such flat configuration may be used to decrease space requirements for storage and shipping of components of the packaging member, while still permitting ease of assembly. In the U-shaped state, the opposed walls 26 are preferentially substantially parallel.

With continued reference to FIGS. 1-3, the locator panel 40 includes an aperture 42 defined by a sidewall 44, with the aperture 42 being located through the face 46 of the panel. In construction, the locator panel may be made from triple-wall corrugated cardboard, although it is contemplated that other suitable materials, such as foam, may also be employed. As shown, the aperture 42, which may be die cut, is preferably centrally located within the locator panel 40. For ease of assembling the packaging member 10, it is envisioned that the locator panel 40 may have a perimeter corresponding to the size of the central portion 22 of the base 20, although any dimensioned locator panel 40 may be employed providing the dimensions are less than those of the base central portion 22. In one non-limiting embodiment, the locator panel 40 may be fifteen inches square, while the aperture may be twelve inches in diameter, although other dimensions are contemplated and may be configured to accommodate the item to be packaged within the packaging member. By locating the spool a predetermined distance from the base edges 26, the spool flange may be protected from damage caused by the impact of dropping the packaged spool on one of the edges of the packaging member.

In addition to the base 20 and the locator panel 40, the packaging member 10 includes a support sheet 60. The support sheet 60 has a central portion 62 and a plurality of spaced apart deflectable tabs 64 extending from the perimeter of the central portion 62. For purposes of this application, a plurality is defined to mean two or more. Each of the spaced apart, foldable tabs 64 includes a first deflectable portion 66 and a second deflectable portion 68. In one embodiment, the spaced apart tabs 64 may be equally spaced apart.

In manufacture, the support sheet 60 is formed from a single sheet of flat material where the spaced apart tabs 64 may be die cut to form the desired configuration. The central portion 62 may be separated from the first tab portions 66 by a score or a perforation. Similarly, each of the first tab portions 66 may be separated from the second tab portions 68 by a score or perforation. Such a configuration permits the support sheets 60 to be stored in a flat stack in order to minimize space necessary to store components of the unassembled packaging member 10. It is also envisioned that this configuration may also permit ease of assembly, as the tabs 64 may be quickly folded into the configuration shown in FIGS. 1-3 prior to assembly.

In assembly, a packaging member 10 may be assembled as follows. The base 20 may be folded or assembled into a U-shaped configuration, followed by placing the locator panel 40 onto the central portion 22 between the opposed walls 24, such that the perimeter of the locator panel 40 corresponds to the perimeter of the central portion 22. In one embodiment, is envisioned that the locator panel 40 is directly affixed to the central portion 22 by a means for retention, although it is also contemplated that the locator panel 40 may be indirectly retained upon the central portion as well. For example, the means for retention may be an adhesive such as glue, wax, or rubber cement. Alternatively or additionally, the means for retention may be a mechanical fastener, for example staples, brads, rivets, or the like.

Following placement of the locator panel 40 upon the central portion 22, the support sheet 60 may be inserted into the locator panel aperture 42, such that the support sheet central portion 62 is in contact with the base 20. In one embodiment, both the locator panel aperture 42 and the support sheet central portion 62 are circular in shape, however, both of these elements may be configured to accommodate any shaped object as required.

With continued reference to FIGS. 1-3, central portion 62 is affixed to the base 20 by an adhesive, for example, a pressure sensitive or a permanent adhesive. A mechanical fastener may be employed in addition to or as an alternative to the adhesive when affixing the central portion 62 to the base 20. In this assembly, the plurality of flexible spaced apart tabs 64, each having a resiliently deflectable first portion 66 and second portion 68, extend from the perimeter of the central portion 62. The tabs 64 may be folded at a score or perforation separating the tabs 64 from the central portion 62 so that the profile of the first portions 66 correspond to the profile of the sidewall 44. As the profiles of the first portions 66 and the sidewall 44 correspond, the first portions 66 may be affixed to the sidewall 44 by an adhesive.

Affixation of the first portions 66 to the sidewall 44 may serve to reduce the impact on the sidewall 44 from spool flanges 92 during transportation. Additionally, certain spools may be dimensioned such that transportation-associated motion may cause a flange to impinge upon a sidewall 44. Absent the first portions 66, the flange may become lodged between layers of the exposed corrugated cardboard of the sidewall 44, whereby additional transportation motion may cause further shifting of the flange back and forth between the cardboard layers, resulting in cumulative damage to the packaging member. Therefore, first portions 66 may additionally decrease damage to the locator panel during transportation of spools. Furthermore, the first portions 66 may distribute impact energy, resultant from dropping a packaged spool, over a greater portion of sidewall 44 than a design absent first portions 66.

Additionally, the tabs 64 may also be folded at a score or perforation separating the first portions 66 from the second portions 68, such that the second portions 68 extend radially away from the central portion 62. In such a configuration, second portions 68 are affixed to one of the locator panel faces 46 by, for example, by an adhesive or suitable mechanical fasteners. Given that the second portions 68 are affixed to a locator panel face 46, that the first portions 66 are affixed to the sidewall 44, and that the central portion 62 is affixed to the base 20, it should be understood that locator panel 40 may be indirectly retained upon base 20 by support sheet 60.

Alternatively or additionally, the packaging member may also include a top ply, which is formed from single ply corrugated cardboard, craft paper, or the like. In one embodiment, the top ply may be dimensioned to have the same or similar perimeter as the base central portion and the planar locator panel. Additionally, the top ply may include an aperture having the same or similar dimensions as the locator panel aperture. As is also the case for panel aperture, the ply aperture may preferably be circular in shape, although the aperture may be configured to accommodate any shaped object, as required. In assembly, the top ply may be affixed to the locator panel face and the second tab portions. As such, the likelihood of any of the second tab portions delaminating from the locator panel face may be decreased.

Figure 4:
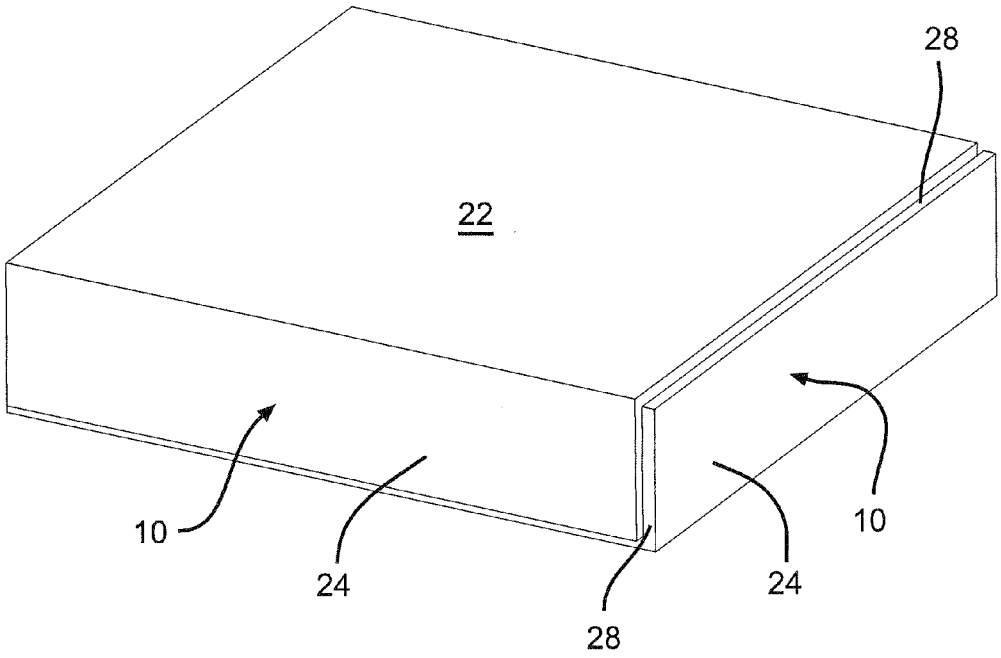
FIG. 4 is a perspective view of the packaging member shown in FIG. 1 with a second packaging member superposed thereon.

In order to package an object for storage or shipping, and with reference again to FIGS. 1-3, one end of a spool 90 or other elongated object is inserted into the aperture 42 of one packaging member 10, as shown specifically in FIG. 3. Turning to FIG. 4, a second packaging member 10 may be inverted and rotated 90 degrees relative to the first packaging member 10, such that the apertures 42 of the packaging members 10 and the longitudinal axis of the spool are coaxial. The second packaging member 10 may then be placed in superposed relation to the first packaging member, which for purposes of this application is means that the second packaging member 10 is inverted and rotated 90 degrees relative to the first packaging member 10 and that the second packaging member 10 is oriented on top of the first packaging member 10. Once the second packaging member 10 is placed in superposed relation to the first packaging member 10, the other end of the spool 90 is located within the aperture 42 of the second packaging member 10. As shown in FIG. 4, when first and second packaging members 10 are in superposed relation, the opposed walls 24 may not extend past each other; rather, a channel 28 may be formed at the intersection of the opposed walls 24. After the packaging members 10 are arranged in superposed relation, a means for securing the packaging members may be utilized to maintain the packaging members is such relationship. For example, the packaging members may be maintained in superposed relationship using tape, mechanical fasteners, or glue. Additionally or alternatively, the packaging members 10 may be maintained in superposed relation by insertion into a box or carton dimensioned to receive the packaging members. Such a configuration effectively increases the amount of material at the corner of a carton, thereby increasing the structural strength of the carton at its corners.

Figure 5:
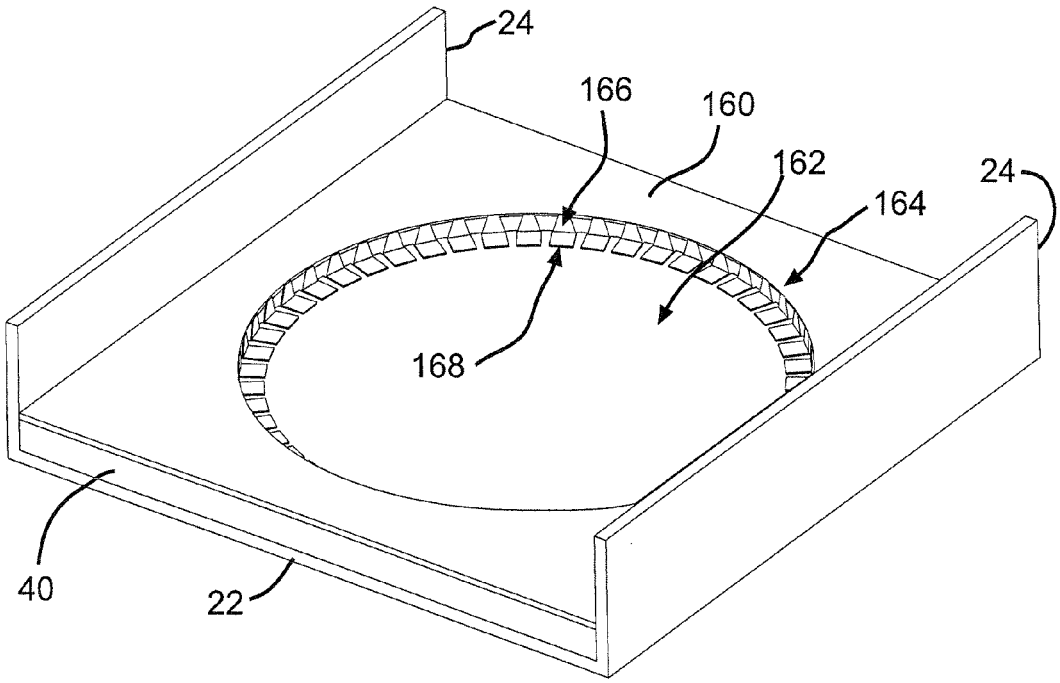
FIG. 5 is a perspective view of another alternate embodiment of a packaging member.
Figure 6:
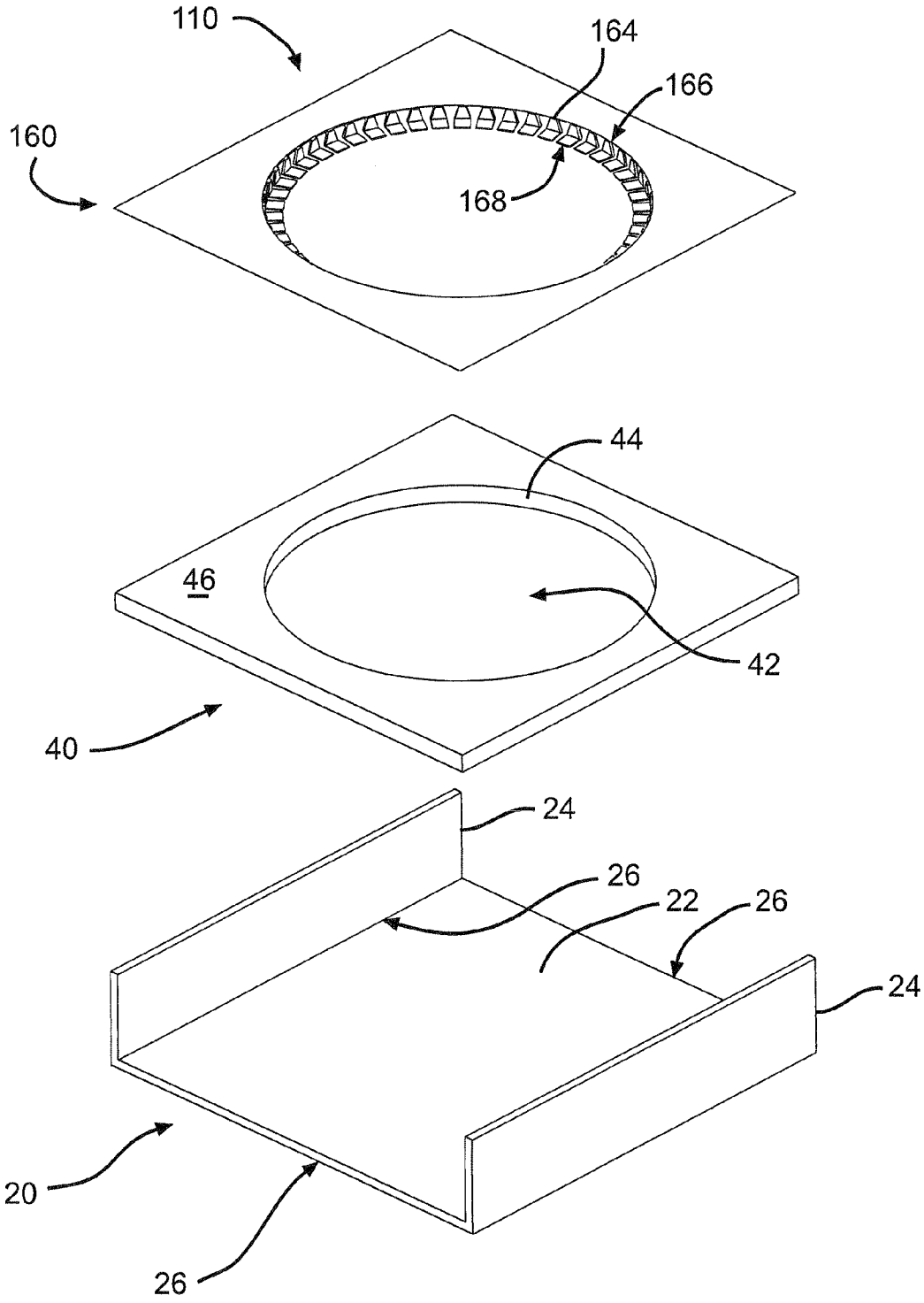
FIG. 6 is an exploded perspective view of the packaging member shown in FIG. 6.

Referring now to FIGS. 5 and 6, another embodiment of a packaging member 110 is shown. The packaging member 110 comprises a base 20, a locator panel 40, and a support sheet 160. In manufacture, the support sheet 160 is formed from a single sheet of flat material and has a support sheet body 161 and a central aperture 162. A plurality of flexible spaced apart tabs 164 extend from the support sheet body 161. Each resiliently bendable spaced apart tab 164 includes a first deflectable portion 166 and a second deflectable portion 168 extending from the first portion 166. Each first tab portion 166 may be separated from the support sheet body 161 by a score or by perforations, and similarly, each first tab portion 166 may be separated from a corresponding second tab portion 168 by a score or a perforation. It is envisioned that this configuration may also permit ease of assembly, as the tabs 164 may be quickly formed or folded into the configuration shown prior to assembly.

Following placement of the locator panel 40 upon the central portion 22 as described above with reference to a previous embodiment, the support sheet 160 is affixed to the locator panel 40 between the opposed walls 24 by an adhesive or other methods, such as the use of mechanical fasteners. The tabs 164 may be folded at a score or perforation separating the tabs 164 from the support sheet body 161 so that the profiles of the first portions 166 correspond to the profile of the sidewall 44. As the profiles of the first portions 166 and the sidewall 44 correspond, the first portions 166 are then affixed to the sidewall 44 by an adhesive. Additionally, the second portions 168 may extend from the first portions 166 radially toward the center of the support sheet aperture 162. In such a configuration the second portions 168 may be affixed to the base 20 by an adhesive or by mechanical fasteners, which may be, for example, staples.

Figure 7:
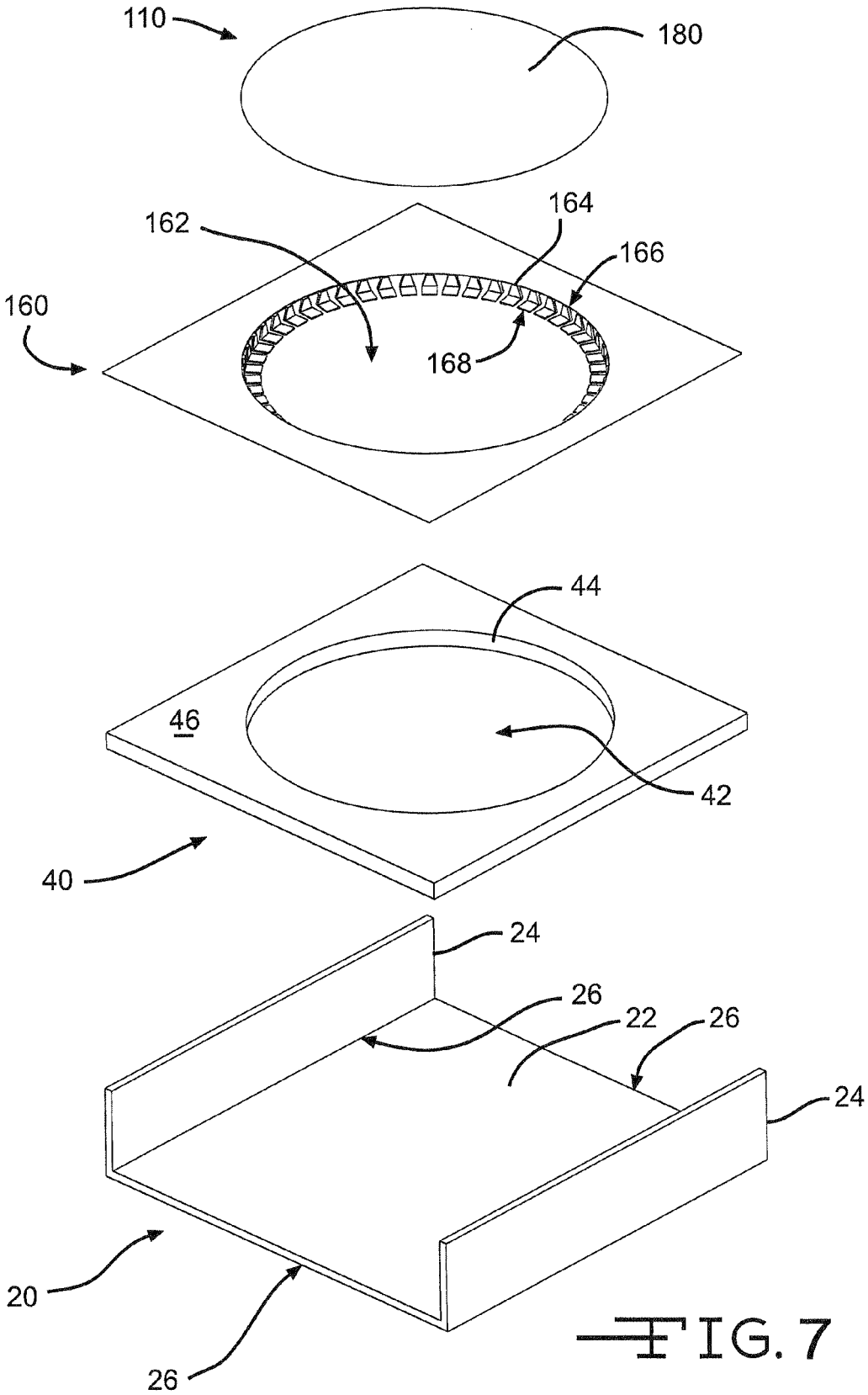
FIG. 7 is an exploded perspective view of an alternate embodiment of a packaging member.

In a further embodiment, and as shown in FIG. 7, to cover the second portions 168 and to decrease the likelihood of delamination of the same, a ply 180 having a perimeter corresponding to the locator panel aperture 42 is placed in the locator panel aperture and affixed to the second portions 168 and the base 20.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiments disclosed, but that the claimed subject matter will include all embodiments falling within the scope of the appended claims.

What is claimed is:

1. A packaging member comprising:

a base having a central portion and a pair of opposed walls extending in the same direction from opposing edges of the central portion;

a locator panel having a perimeter corresponding to the perimeter of the base central portion and an aperture defined by a sidewall, where the locator panel is retained upon the base between the pair of opposed walls; and a plurality of spaced apart tabs having a first portion corresponding to the profile of the sidewall and securely affixed to the sidewall and a second portion is extending substantially perpendicular to the first portion.

2. The packaging member of claim 1 further comprising a support sheet, where the first portion of each of the plurality of spaced apart tabs extend from the perimeter of the support sheet.

3. The packaging member of claim 2, where the support sheet includes a central portion inserted within the central aperture of the locator panel and affixed to the base.

4. The packaging member of claim 3, where the spaced apart tabs include the second portion extending from the first portion radially away from the support sheet central portion and affixed to a face of the locator panel.

5. The packaging member of claim 1 further comprising a support sheet including a body affixed to the locator panel and having an aperture corresponding to the locator panel aperture.

6. The packaging member of claim 5, where the plurality of spaced apart tabs extend from the support sheet body.

7. The packaging member of claim 6, where the spaced apart tabs include the second portion extending from the first portion radially toward the center of the support sheet aperture and affixed to the base.

8. The packaging member of claim 7 further comprising a ply inserted into the locator panel aperture and affixed to the second portions of the spaced apart tabs and the base.

9. A package comprising:

at least one packaging member having a base having a central portion and a pair of opposed walls extending in the same direction from opposing edges of the central portion;

a locator panel having a perimeter corresponding to the perimeter of the base central portion and an aperture defined by a sidewall, where the locator panel is affixed to the base between the pair of opposed walls; and a support sheet having a central portion inserted within the locator panel aperture and affixed to the base, and a plurality of spaced apart tabs extending from the perimeter of the central portion, with each of the tabs having a first portion corresponding to the profile of the sidewall and affixed to the sidewall and a second portion extending from the first portion radially away from the central portion and affixed to a face of the locator panel.

10. The package of claim 9 comprising two packaging members disposed in superposed relation.

11. The package of claim 9, where the base is formed from double-wall corrugated cardboard.

12. The package of claim 9, where the locator panel is formed from triple-wall corrugated cardboard.

13. The package of claim 9, where the support sheet is formed from single ply cardboard.

14. The package of claim 9, where the locator panel central aperture and the support sheet central portion are substantially circular.

15. The package of claim 9, where the base central portion and the locator panel are substantially square.

16. The package of claim 9, where the sidewall defining the locator panel aperture is substantially perpendicular to the faces of the locator panel.

17. A method for packaging a spool comprising the steps of:

providing a pair of packaging members, each packaging member having a base having a central portion and a pair of opposed walls extending in the same direction from opposing edges of the central portion;

a locator panel having a perimeter corresponding to the base central portion and an aperture defined by a sidewall, where the locator panel is affixed to the base between the pair of opposed walls; and a support sheet having a central portion inserted within the locator panel aperture and affixed to the base, and a plurality of spaced apart tabs extending from the perimeter of the central portion, with each of the tabs having a first portion corresponding to the profile of the sidewall and affixed to the sidewall and a second portion extending from the first portion radially away from the central portion and affixed to a face of the locator panel;

inserting one face of the spool into the locator panel aperture of one of the packaging members;

placing the locator panel aperture of the other packaging member onto the other face of spool such that the packaging members are in superposed relation; and maintaining the packaging members in superposed relation by a means for securing.

18. The method for packaging a spool of claim 17, further comprising the step of inserting the packaging members and the spool into a carton.

19. The method for packaging a spool of claim 17, where the locator panel central aperture and the support sheet central portion are substantially circular.

20. The method for packaging a spool of claim 17, where the sidewall defining the locator panel aperture is substantially perpendicular to the faces of the locator panel.

* * * * *